United States Patent [19]

Schaffner

[11] Patent Number: 4,488,819

[45] Date of Patent: Dec. 18, 1984

[54] ELECTRONIC WATCH MOVEMENT WITH MODULAR STEPPER MOTOR AND SETTING MECHANISM

[75] Inventor: Jean-Claude Schaffner, Delémont, Switzerland

[73] Assignee: ETA S.A., Fabriques d'Ebauches, Granges, Switzerland

[21] Appl. No.: 601,454

[22] Filed: Apr. 18, 1984

[30] Foreign Application Priority Data

May 5, 1983 [CH] Switzerland ..... 2450/83

[51] Int. Cl.[3] ..... G04B 19/02; G04B 29/00

[52] U.S. Cl. ..... 368/220; 368/319

[58] Field of Search ..... 368/76, 80, 88, 157, 368/160, 220, 318, 319; 310/40 MM

[56] References Cited

U.S. PATENT DOCUMENTS 4,086,753 5/1978 Tsuchita et al. ..... 310/40 MM 4,426,158 1/1984 Muller et al. ..... 368/76

FOREIGN PATENT DOCUMENTS 2094039 9/1982 United Kingdom .

*Primary Examiner*—Vit W. Miska

*Attorney, Agent, or Firm*—Pollock, Vande Sande & Priddy

[57] ABSTRACT

The stator (10) of the motor serves as a single plate, not only for the rotor, wheels and spindles for hands, but also for the rocker (72), the pulling crank (70) and the setting pinion of the minutes wheel. The stator is shaped locally to form, on the one hand, a groove which guides the end of the setting stem (64) and, on the other hand, a boss (84) into which is driven a pin (82) serving as a spindle for the setting pinion (80).

2 Claims, 3 Drawing Figures

ELECTRONIC WATCH MOVEMENT WITH MODULAR STEPPER MOTOR AND SETTING MECHANISM

DESCRIPTION

1. Technical Field

The present invention relates to watch movements with analog displays. More particularly, the invention concerns an analog watch movement in which the spindles for the hands as well as the rotor of the stepper motor are mounted rotatably in bores formed in the stator of the stepper motor, while the pivoted parts of the movement which are not supported by the spindles of the hands are also mounted rotatably in the stator. Thus the stator serves, with no need for any bridge, as the only plate for the assembly of the elements which comprise the motor module.

2. Background Art

A watch of this general type is made and sold under the brand name SWATCH by Allgemeine Schweizerische Uhrenindustrie AG (ASUAG) of Switzerland. Its construction is also described in British Pat. No. 2,094,039. Manufacturing a watch designed in this manner permits not only the elimination of a bridge, but also the provision of a watch of relatively slight thickness which is easy and inexpensive to manufacture. Moreover, the mounting of the motor module in the watch requires no delicate operations.

DISCLOSURE OF THE INVENTION

The present invention concerns an improvement in the watch movement and method of manufacture embodied in the SWATCH brand watch. The improvement concerns also mounting on the stator the time setting mechanism of the watch. This mechanism generally comprises a sliding setting stem; a toothed pinion known as a sliding pinion mounted to slide along but rotate with the stem; a mechanism comprising a rocker and a pulling crank, which respond to sliding of the stem to move the sliding pinion between a rest position and an active position; and finally, a setting pinion meshing with one of the gear wheels of the movement and with the sliding pinion, when the latter is in the active position. According to the invention, the stator of the motor serves as the only support plate, not only for the assembly of the elements comprising the motor module, as this is realized in the SWATCH brand watch, but also for the rocker, the pulling crank and the setting pinion of the setting mechanism.

Thus, a modular assembly is provided which includes, with the exception of the setting stem, all of the moving elements of the watch whose assembly into the watch otherwise would require rather delicate operations. This modular assembly can therefore be provided separately by regrouping all the delicate operations in one phase of manufacture and then mounted in the watch by an operation which requires no particular precision. Moreover, and this constitutes an important advantage of the invention, the position of the setting pinion in relation to the rocker and pulling crank assembly is perfectly guaranteed.

BRIEF DESCRIPTION OF THE DRAWING

Other characteristics and advantages of the present invention will appear from the description which follows, made with reference to the attached drawings and giving, by way of explanation but in no way of limitation, one advantageous embodiment of the invention. In the drawings.

BEST MODE FOR CARRYING OUT THE INVENTION

In the Figures there is shown the stator 10 of a Lavet motor, which simultaneously has the normal function of a magnetic circuit for guiding the magnetic field created by the coil and the additional function of providing a single plate for the gear wheels, the spindles for the hands and the setting mechanism. Stator 10 is made, for example, of a ferro-nickel alloy sold under the brand name VACOPERM and typically has a thickness of 0.7 mm.

Figures 1, 3:
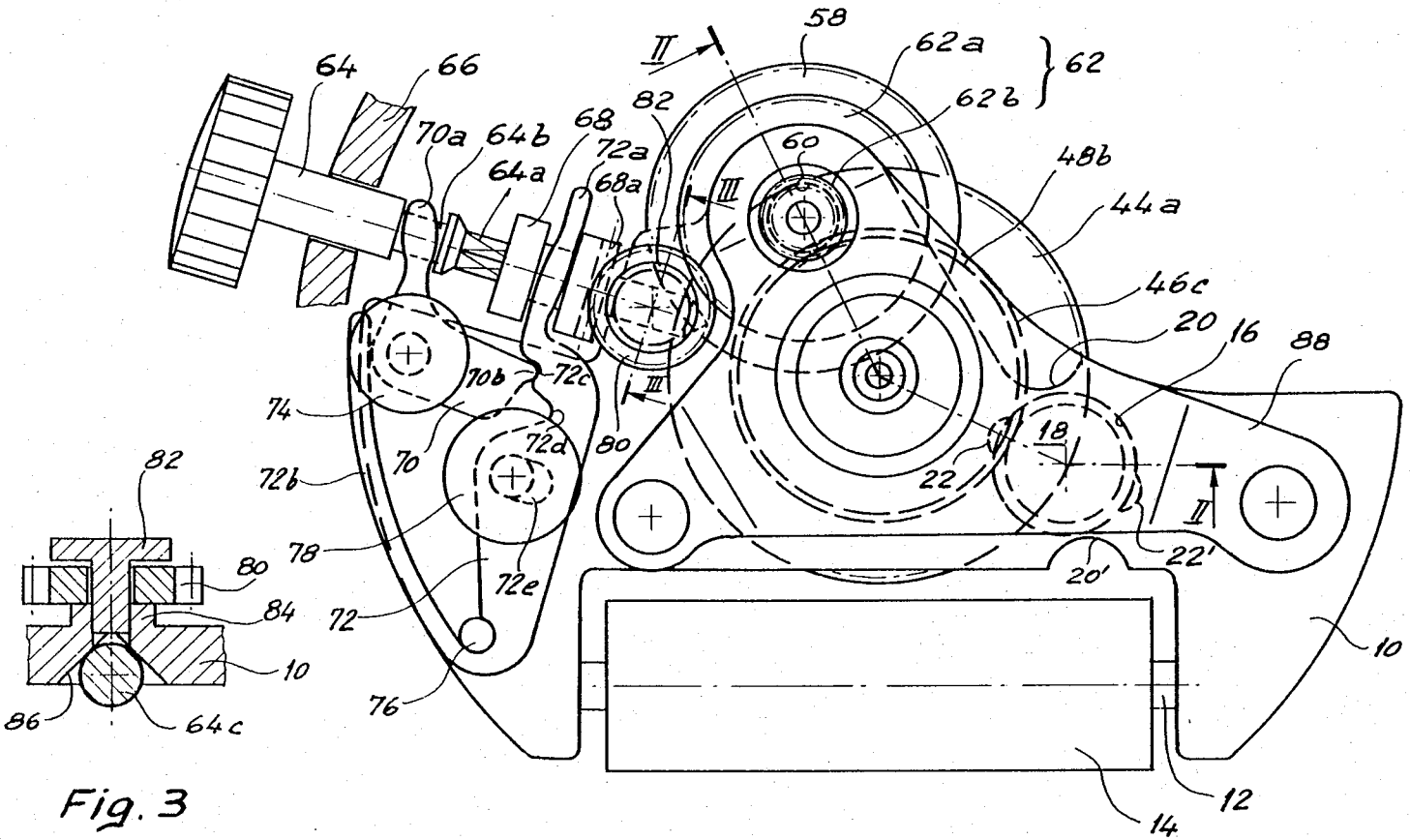
FIG. 1 is a plan view, partially in section, of a portion of a watch movement according to the invention.
FIG. 3 is another view in vertical section along the line III—III in FIG. 1.

FIG. 1 shows that stator 10 has approximately a V-shape, of which the ends are joined to the core 12 of a coil 14. Stator 10 is pierced by a circular bore 16, in which is mounted the rotor 18 of the stepping motor. On opposite sides of bore 16, two notches 20 and 20' are made in stator 10 to define two narrow isthmuses separating the two poles of the stator. Two other notches, 22 and 22', positioned diametrically opposite each other on bore 16 are displaced by about 50 degrees in relation to the diameter which joins notches 20 and 20', thereby defining, as is conventional in such a motor, the rest position of rotor 18.

Figure 2:
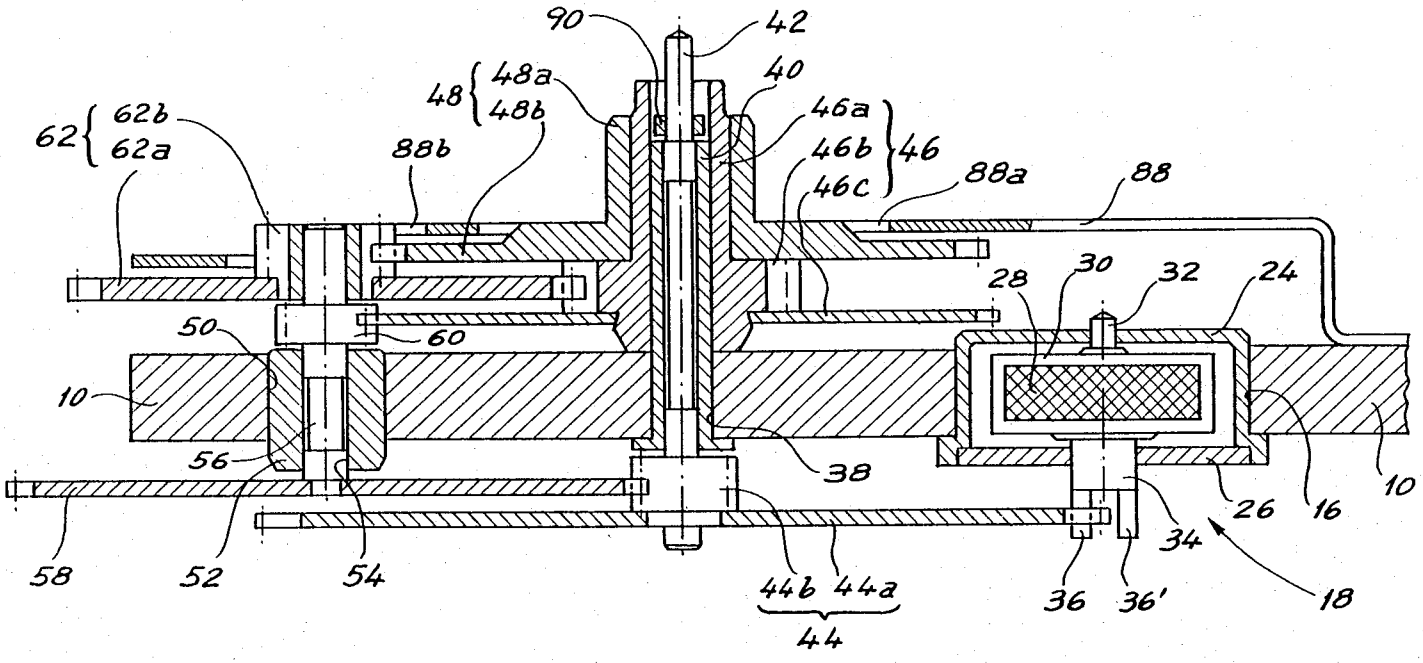
FIG. 2 is a partial view in vertical section along the line II—II in FIG. 1.

As seen in FIG. 2, a cup-shaped member 24, closed by a plate 26, is force fitted into bore 16. Rotor 18 is rotatably mounted inside member 24 and comprises a magnet 28, mounted inside a cage 30 and fixed on a shaft 32 journalled in a bearing provided in the bottom of member 24, and on a shaft 34 journalled in a bearing provided in plate 26. Shaft 34 extends beyond plate 26 and terminates in a pair of axially extending, diametrically opposed lugs or spline portions 36, 36' which function as a pinion. Thus, member 24 and plate 26 assure proper positioning of rotor 18 in relation to stator 10. There is avoided, in this way, the delicate operation of centering the rotor in the stator during the mounting of the movement assembly.

Stator 10 is pierced, substantially at its center, by a second bore 38, which serves for the mounting of the spindles of the hands. As used in this specification, the term "spindle" means either a solid arbor spindle or a hollow pipe spindle. Into bore 38 is driven a guide tube 40 which projects beyond the upper surface of stator 10. The spindle 42 for a second hand is journalled within guide tube 40. The lower end of spindle 42 bears a seconds gear 44, comprising a seconds wheel **44*a*, meshing with lugs 35, 36' and a seconds pinion 44*b*. On the outer surface of guide tube 40 is mounted a minutes gear 46, comprising in the conventional way a pipe spindle 46*a* for a minutes hand, a minutes pinion 46*b* and a minutes wheel 46*c*. On the outer surface of pipe 46*a* is mounted an hour canon gear 48 comprising a pipe 48*a* for an hour hand and an hours wheel 48*b***.

Stator 10 includes a third bore 50, in which is force fitted a sleeve 52, which has an axial bore 54, serving as a bearing for a spindle 56 which extends from one side to the other of stator 10. At its lower end is fixedly mounted an intermediate gear wheel 58 which meshes with seconds pinion 44*b*. At its other end, spindle 56 fixedly supports a pinion 60 which meshes with minutes wheel 46*c*. The upper end of spindle 56 is trued to rotatably support an hours moving gear 62 comprising, in the conventional way, a wheel 62*a* meshing with minutes pinion 46*b* and a pinion 62*b* *meshing with hours wheel 48b*. The spindle 56 has thus a double function. On the one hand, it fixedly supports intermediate wheel 58 and pinion 60 for rotation together; and on the other hand, it rotatably supports hours moving gear 62.

The setting mechanism of the watch, shown in FIG. 1, comprises a setting stem 64, slidably mounted in the familiar manner in the watch casing 66, shown only partially. Stem 64 comprises a portion 64*a* of square cross-section, which mates with a square bore in a sliding pinion 68 so that stem 64 and pinion 68 rotate together. Stem 64 is in its active position when it is pulled outwardly to the position shown in FIG. 1 and is inactive in the pushed-back position. As stem 64 is pulled outward, sliding pinion 68 is moved along portion 64*a* in the inward direction, through the agency of a pulling crank 70 and a rocker 72.

Pulling crank 70 is mounted rotatably on pin 74 fixed to stator 10, pin 74 having a retaining head at its outer end. One end 70*a* of pulling crank 70 is engaged in a portion 64*b* of reduced diameter on stem 64. Rocker 72 is mounted on stator 10 to pivot around a fixed pin 76 which like pin 74 is fixed to stator 10. One end 72*a* of rocker 72 is engaged in a portion of reduced diameter on sliding pinion 68, while the other end 72*b* is stopped against a rounded portion of pulling crank 70 which extends around pin 74. The other end 70*b* of pulling crank 70 may take its place in one or the other of two notches 72*c* and 72*d* formed in rocker 72. Finally, rocker 72 is pierced with an oblong slot 72*e*, through which passes a pin 78, also fixed to stator 10 and also having a retaining head at its outer end. Pin 78 serves both to hold rocker 72 in place on stator 10 and, in cooperation with slot 72*e* to limit its movement about pin 76.

Sliding pinion 68 includes, on its surface facing the center of the movement, a toothed or serrated edge 68*a* which meshes with a setting pinion 80 which in turn meshes with wheel 62*a*. As best shown in FIG. 3, setting pinion 80 is rotatably mounted on a pin 82 having a retaining head at its outer end, pin 82 being force fitted into a hollow boss 84 forming an integral part of stator 10. Boss 84 on one side of stator 10 and a groove 86 on the other side may be formed in a single stamping operation. Groove 86 assures accurate guiding of the end 64*c* of stem 64.

A plate 88, fixed on stator 10 by means shown schematically in FIG. 1, partly covers the moving elements to maintain proper connection between the stepping motor and the spindles for the hands. Plate 88 is pierced by a first opening 88*a*, through which the spindles for the hands pass and a second opening 88*b*, at the level of the upper end of the pinion 62*b*. Plate 88 thus assures the protection of the moving elements and at the same time, during the handling of the motor module, prevents the uppermost elements, such as hour canon gear 48 and gear 62, from escaping from their spindles. Finally, the seconds spindle 42 bears, at its upper part, a ring or sleeve 90 which rotates freely within pipe 46*a*. This ring, coming to a stop against the guide tube 40, prevents seconds wheel 44 from falling during handling of the motor module.

In use of the mechanism described, when stem 64 is in the pushed-back position, end 70*b* of pulling crank 70 takes its place in notch 72*d* of rocker 72. At the same time rocker end 72*a* pushes sliding pinion 68 and its serrated edge 68*a*, away from pinion 80. Thus sliding pinion 68 is in its rest position and rotation of stem 64 has no effect on pinion 80. But, when stem 64 is pulled to the position shown in FIG. 1, end 70*b* of pulling crank 70 takes its place in notch 72*c* of rocker 72. At the same time, rocker end 72*a* pushes sliding pinion 68 to its active position by moving it in the direction of pinion 80, so that serrated edge 68*a* meshes with pinion 80. Rotation of stem 64 is then transmitted through pinion 80 to wheel 62*a* and thus permits driving the spindles for the hands to set the time.

The advantages of the invention now appear very clearly. The first advantage is that the resultant motor module includes, except for the setting stem, all the movable mechanical elements of the watch. This module may be assembled separately, then mounted in the watch by an extremely simple operation which requires no particular care. Another advantage of the invention resides in the complete elimination of bridges due to use of a single plate consisting of the stator of the motor itself. This results in a substantial reduction of the total thickness of a watch equipped with such a module. A third advantage of the invention is that since most of the setting mechanism and the setting pinion are mounted on the stator, it is very easy to guarantee their relative positions. Finally, a fourth advantage of the invention is that guiding the end of the setting stem is assured without other means than a portion of the stator itself.

Obviously, the present invention is not limited to the single mode of execution shown, but the coverage of the present application extends also to variants of all or part of the arrangements described, remaining within the frame of equivalents, as well as any application of such arrangements.

Having described my invention in sufficient detail to enable those skilled in the art to make and use it, I claim as new and desire to secure Letters Patent for:

1. An electronic watch movement, comprising:

a motor including a coil, a stator and a rotor, said rotor being mounted to pivot in said stator;

spindles for the hands of a watch, said spindles also being mounted to pivot in said stator;

gear means for assuring kinematic connection between said rotor and said spindles for the hands, said gear means being mounted on further spindles which pivot in said stator;

a sliding setting mechanism including a setting stem;

means for supporting said stem for sliding and rotating movement;

a sliding pinion mounted to slide along said stem but to rotate with said stem;

means mounted on said stator for responding to the sliding of said stem to move said sliding pinion between a rest position and an active position; and a setting pinion mounted for rotation on said stator meshed with one of said gear means and positioned for meshing with said sliding pinion when said sliding pinion is in said active position, whereby rotation of said stem causes said sliding pinion to rotate said setting pinion which rotates said gear means to adjust the position of said spindles for the hands of a watch.

2. A watch movement according to claim 1, wherein said stator is deformed locally to provide on one side, a guide groove for the end of said stem and, on the opposite side, a hollow boss for rotatably supporting a spindle for said setting pinion, whereby said sliding pinion and said setting pinion are accurately positioned for meshing.

* * * * *